United States Patent [19]

Duesling

[11] 4,062,766

[45] Dec. 13, 1977

[54] CENTRIFUGAL SEPARATOR

[75] Inventor: Clarence Lehi Duesling, Port Elgin, Canada

[73] Assignee: Canarco Incorporated, Port Elgin, Canada

[21] Appl. No.: 744,340

[22] Filed: Nov. 23, 1976

[30] Foreign Application Priority Data

Aug. 31, 1976 Canada ..... 260246

[51] Int. Cl.[2] ..... B04C 5/181

[52] U.S. Cl. ..... 209/211

[58] Field of Search ..... 209/211, 144; 210/512 R, 84, 304, 311, 528; 259/43, 44; 55/404

[56] References Cited

U.S. PATENT DOCUMENTS

| | | | |
|---|---|---|---|
| 1,109,143 | 9/1914 | Perkins | 259/43 |
| 2,447,119 | 8/1948 | Goodyer | 55/404 |
| 2,909,283 | 10/1959 | Duesling | 209/211 |
| 3,010,579 | 11/1961 | Duesling | 209/211 |
| 3,986,592 | 10/1976 | Baillie et al. | 210/528 |

*Primary Examiner*—Frank W. Lutter
*Assistant Examiner*—Jon Hokanson
*Attorney, Agent, or Firm*—Fetherstonhaugh & Co.

[57] ABSTRACT

In a fluid media gravity separator a concentrator bowl having a side wall and a bottom wall that slopes downwardly and inwardly, said bottom wall being formed with a central concentrate discharge port, a media feed injector having a passage with a discharge opening to direct fluid passed therethrough at a high velocity in a spiral path of decreasing radius over the bottom of said bowl that terminates at said discharge port, a splitter in said bowl at said discharge port with a splitting edge in spaced relation to the edge of said discharge port to divide material flowing over said bottom of said concentrating bowl in a spiral path as aforesaid into a portion that flows through said discharge port of said concentrating bowl and a portion that flows upwardly of the central portion of said concentrating bowl, a vortex tube in said concentrating bowl overlying said splitter with its input end overlying said splitter to receive the portion of material split by said splitter that is directed upwardly in said bowl, said vortex tube having a discharge outlet for materials directed thereinto as aforesaid, the improvement of a rotatable mounting means for said splitter to permit said splitter to rotate about the vertical axis of said bowl in use, said splitter being rotatably mounted on its mounting means, and means for rotating said splitter in use.

3 Claims, 3 Drawing Figures

CENTRIFUGAL SEPARATOR

This invention relates to a fluid media gravity separator and is useful for the recovery of heavy minerals from mine mill tailings. While its principal intended use is the recovery of heavy minerals from mine mill tailings it is also useful in many industrial processes where liquid media consisting of different specific gravity materials are to be separated.

Gravity separation of fluid media for the purpose of recovering valuable ore from mine tailings is common. The Humphrey's spiral and vibrating table separators are commonly used. The present invention is of a different type but is not new in basic principal. A separator of the type to which this invention relates is disclosed in U.S. Pat. No. 3,010,579 dated Nov. 28, 1961 to C. L. Duesling. While separators of this type have been generally known at least since 1967 they have not been used in common practice. One of the difficulties with the separators is that they tend to clog.

While operation of the type of gravity separator to which this invention relates has been difficult, the device has inherent advantages over other gravity separators. One of them is that it is one of the fastest gravity separators known.

This invention overcomes the operational difficulties experienced with the type of separator illustrated in U.S. Pat. No. 3,010,579 and thereby makes available the desirable advantage of fast gravity separation.

It is, therefore, an object of this invention to provide a fluid media gravity separator of the bowl type wherein the fluid media is tangentially forced into the bowl to separate it according to gravity of the components and split it into two streams one being a concentration of the heavier materials and the other being lighter materials.

The invention, then relates to a fluid media gravity separator of the type having a concentrating bowl having a side wall and a bottom wall that slopes downwardly and inwardly; said bottom wall being formed with a central concentrate discharge port; a media feed injector having a passage with a discharge opening to direct fluid past therethrough at a high velocity in a spiral path of decreasing radius over the bottom of said bowl that terminates at said discharge port; a splitter in said bowl at said discharge port with a splitting edge in spaced relation to the edge of said discharge port to divide material flowing over the bottom of said bowl in a spiral path as aforesaid into a portion that flows through said discharge port of said bowl and a portion that flows upwardly of the central portion of said bowl; a vortex tube in said bowl overlying said splitter with its input end overlying said splitter to receive the portion of material split by said splitter that is directed upwardly in said bowl; said vortex tube having a discharge outlet for materials directed thereinto as aforesaid; the improvement of a rotatable mounting means for said splitter to permit said splitter to rotate about the vertical axis of said concentrating bowl in use, said splitter being rotatably mounted on its mounting means, and means for rotating said splitter in use. The invention will be clearly understood after reference to the following detailed specification read in conjunction with the drawings.

Figure 1:
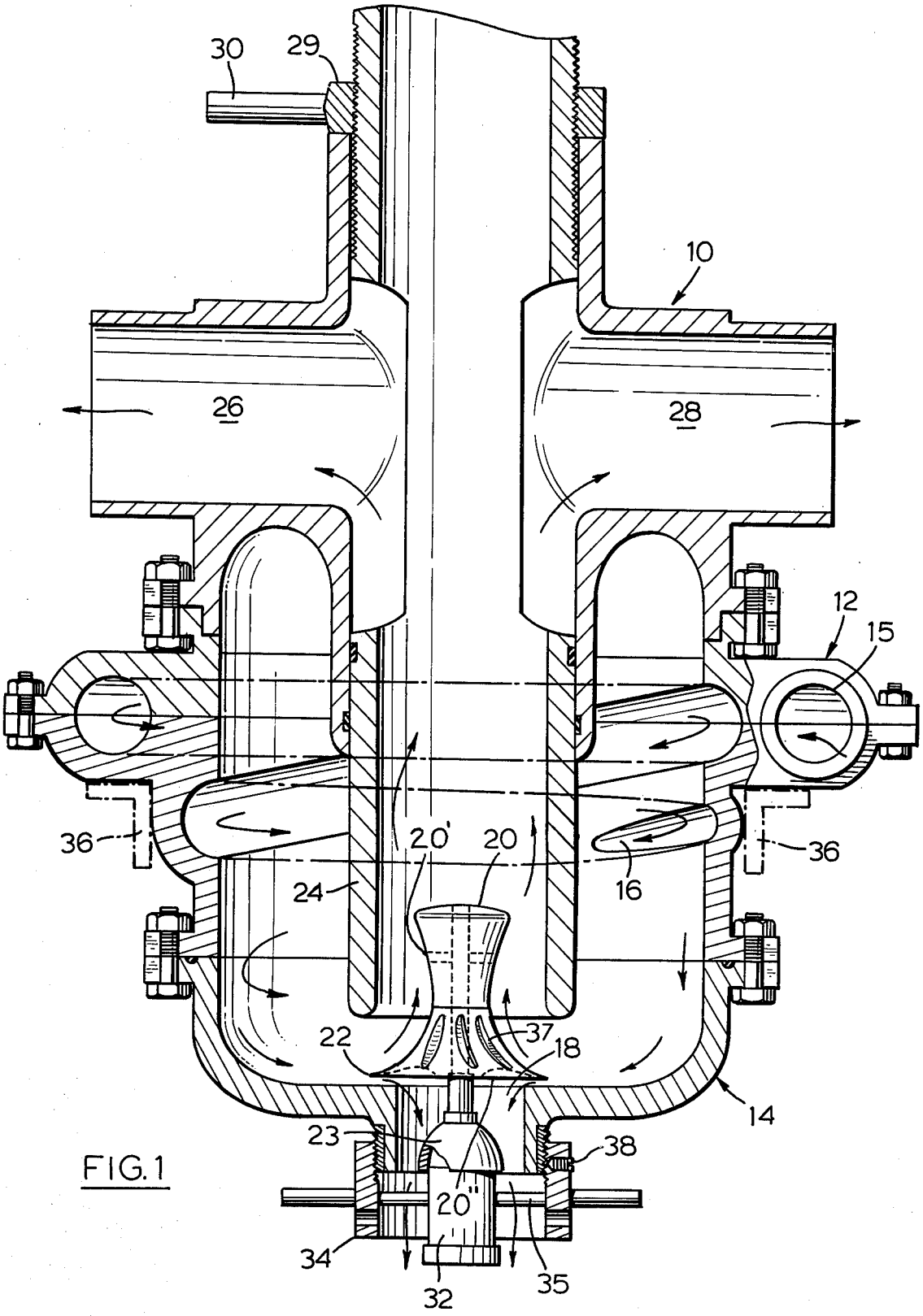
FIG. 1 is a sectional view of a separator according to this invention.
Figure 2:
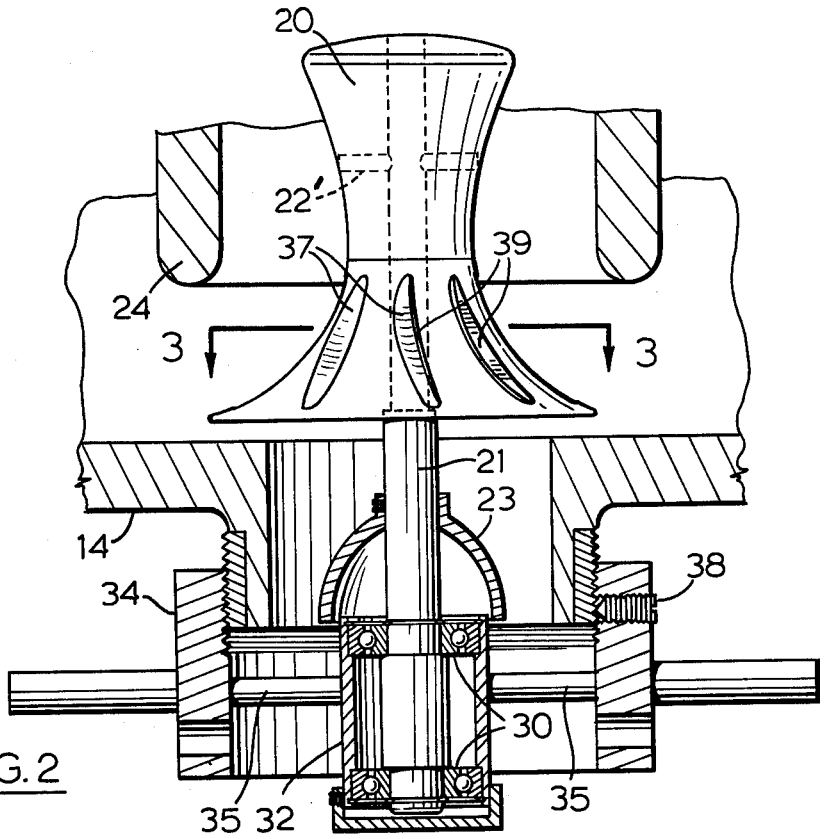
FIG. 2 is a sectional view of the mounting for the splitter.
Figure 3:
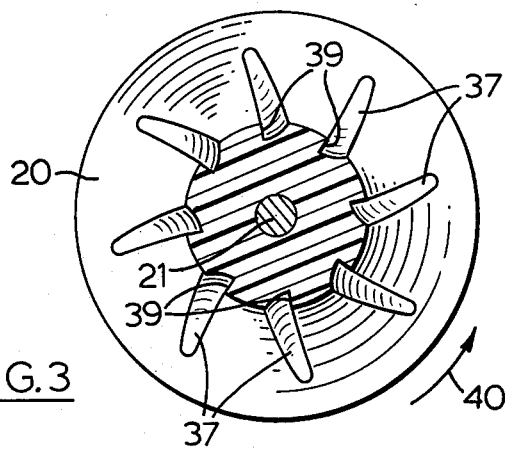
FIG. 3 is a view of the splitter along line 3—3 of FIG. 2.

The separator illustrated in the drawings has three principal cast iron sections held together by easily detachable open slot bolts. They comprise the top section generally indicated by the numeral 10, a mid-section generally indicated by the numeral 12 and a bottom bowl section 14. These sections are bolted together as illustrated and it is not thought that detailed reference to their assembly in this respect is necessary.

The three section housing has a downwardly extending tubular spiral input passage, the input of which is indicated by the numeral 15 and the discharge opening of which is indicated by the numeral 16. In use fluid media containing particles of different gravities for separation is forced at high velocity through the spiral feed passage and directed in a downward direction against the side wall of the interior of the concentrating bowl.

The fluid so admitted to the bowl works its way in a spiral fashion downwardly of the bowl against the wall of the bowl. When it reaches the curved bottom portion of the bowl it proceeds towards the centre of the bottom of the bowl and the discharge port 18.

As the fluid media is forced through the spiral passage and following that down the outside and bottom of the bowl the heavier materials are urged towards the outside of the bowl by centrifugal force. The lighter materials tend to be towards the inside of the bowl. Thus, as the material flows along the bottom of the bowl towards the splitter 20 it has been previously formed into strata on the surface of the bowl.

The splitter 20 has an upper surface 20', a lower surface 20'', and a splitting edge 22. The splitting edge 22 overlies and has a diameter greater than the diameter of the discharge port 18 and it is located to separate the strata of material close to the surface of the bowl and direct it through the discharge port 18. The upper surface 20' of the splitter 20 slopes upwardly from its edge 22 and directs the strata above the strata that is directed through the discharge port 18 upwardly and substantially into a vortex tube 24. Vortex tube 24 has two outlets 26 and 28 through which the strata of fluid media that is directed thereinto can flow from the separator.

The principal of the fluid media gravity separator thus far is clear and, as indicated above, it is not broadly new. The principal of separating a fluid media by forcing it into a spiral path against the side and bottom of a bowl and splitting it according to strata on the bottom of the bowl has been disclosed in Duesling U.S. Pat. No. 3,010,579 noted above.

The improvement of this invention is the mounting of the splitter 20 so that it can rotate. Separators of this general type tended to become clogged at the passage between the splitter and the discharge port. It has been found that by providing a rotatable mounting means for the splitter 20 and a means for rotating the splitter, clogging at this location can be eliminated.

Splitter 20 is secured to spindle 21 by means of pin 22. Spindle 21 is rotatably mounted in bearings 30 which are housed in the central boss 32 of a threaded collar 34. Boss 32 is carried by spokes 35 and collar 34 is set in a position by set screw 38. A shield 23 prevents bearing damage due to grit from the product.

Collar 34 is screw threaded to the separator bowl and can be adjusted vertically to increase or decrease the height of the separator in the bowl whereby to increase or decrease the depth of the stratum that is directed into outlet 18.

Splitter 20 has grooves 37 formed with oblique wall portions 39 which serve as vanes to cause rotation of the splitter due to flow of the material through the bowl. Splitter 20 rotates in the direction of the arrow which, of course, coincides with the spiral direction of the slurry from the entry port 15.

The provision of vanes as illustrated has provided a satisfactory means for rotating the rotatably mounted splitter in use. However, it is contemplated that other rotating means could be provided. For example, one might rotatably drive the splitter.

The vortex tube 24 is adjustable vertically within the bowl and has a threaded portion at its upper end which is engaged by a nut 29. Nut 29 bears on the bowl and can be turned by manipulating handle 30. It will be apparent that by rotation of nut 29 vortex tube 24 can be raised or lowered to suit operating conditions.

In use the separator is supported in an operational position on angle bar supports 36 which are adapted to engage with the underside of the flange on the middle section 12 of the housing. Slurry fluid media supplied to the unit is from a feed slurry tank which is provided with a slurry agitator to control consistancy and density of the feed. A concentrate retaining tank is required to accumulate the output from the discharge port 18 and a tailings retention tank is required to house the output from the vortex discharge tube. A high volume slurry pump of at least 10 horse power for a 1.5 inch feed input has been used for operation. A pressure control valve and pressure monitoring gauge are also necessary on the feed input line.

In use the density of the slurry, feed pressure (rate of slurry feed), splitter setting and vortex tube setting are the variable parameters of operation and these are varied to achieve best separation.

A unit of the type illustrated has been extensively tested in the separation of iron ore tailings which consisted of specular hematite ground through a ten mesh screen, the major impurity of the ore being silica. Each of the variable parameters noted above was varied and the following working range limits were established.

| Parameter | Working Range Limited |
|---|---|
| Slurry Density | 20 to 25% |
| Feed Pressure | 15 to 20 lbs/in$^2$ |
| Splitter Setting | 2 to 3 turns (open) |
| Vortex Tube Setting | 2.5" to 4.5" above splitter |

Tests were carried out at predetermined optimum conditions.

The rate of processing per single unit was approximately 60 to 70 tons per hour of feed slurry and the mineral recovery of a single pass was approximately 70% at optimum operating conditions. It is contemplated that a double pass through the concentrator will achieve a very good mineral concentrate. The separator is thought to be one of the fastest gravity separators known. Its upgrading ratio from the original feed may tend to be low but having regard to its speed it can be used with a double pass and still show substantial advantage over commonly used equipment. The unit is, moreover, very simple and easy to maintain.

The unit has no moving parts with the expection of the self-propelled rotating splitter. The only maintainance required is maintainance to the auxiliary support equipment such as the slurry pump and agitator. The separator of itself is thought to be totaly free of mechanical maintainance.

The embodiments of the invention in which an exclusive property of privilege is claimed are defined as follows.

1. In a fluid medium centrifugal separator a concentrator bowl having a side wall and a bottom wall that slopes downwardly and inwardly;

said bottom wall being formed with a central concentrate discharge port;

a medium feed injector having a passage with a discharge opening to continuously direct fluid passed therethrough at a high velocity in a spiral path of decreasing radius over the bottom of said bowl that terminates at said discharge port;

a splitter in said bowl overlying said discharge port, said splitter having an upper surface and a lower surface, said upper surface of said splitter merging with said lower surface of said splitter to form a continuous splitting edge of said splitter, said splitting edge of said splitter overlying and having a diameter greater than the diameter of said discharge port to divide material flowing over said bottom of said concentrating bowl in a spiral path as aforesaid into split paths one split portion flowing through said discharge port of said concentrating bowl and the other split portion flowing over said upper surface of said splitter and upwardly of the central portion of said concentrating bowl;

a vortex tube in said concentrating bowl overlying said splitter with its input end overlying said splitter to receive the portion of material split by said splitter that is directed upwardly in said bowl;

said vortex tube having a discharge outlet for materials directed thereinto as aforesaid;

the improvement of a rotatable mounting means for said splitter to permit said splitter to rotate about the vertical axis of said bowl in use, said splitter being rotatably mounted on its mounting means, and means for rotating said splitter in use.

2. A fluid medium centrifugal separator as claimed in claim 1 in which said upper surface of said splitter curves upwardly and inwardly from said splitting edge of said splitter to guide the flow of material upwardly through said bowl.

3. A fluid medium centrifugal separator as claimed in claim 1 in which said means for rotating said splitter in use comprises vanes on said splitter engageable by medium flowing through said concentrating bowl to rotate it about its rotatable mounting means in response to medium movement through the bowl.

* * * * *